US009218931B2

(12) United States Patent
Lee et al.

(10) Patent No.: US 9,218,931 B2
(45) Date of Patent: Dec. 22, 2015

(54) ELECTROMAGNETIC FORCE DRIVING DEVICE

(71) Applicant: Soonchunyang University Industry Academy Cooperation Foundation, Asan-si (KR)

(72) Inventors: HeeJoon Lee, Asan-si (KR); HakMin Kim, Asan-si (KR)

(73) Assignee: Soonchunyang University Industry Academy Cooperation Foundation, Asan-si (KR)

( * ) Notice: Subject to any disclaimer, the term of this patent is extended or adjusted under 35 U.S.C. 154(b) by 0 days.

(21) Appl. No.: 14/501,349

(22) Filed: Sep. 30, 2014

(65) Prior Publication Data

US 2015/0187481 A1 Jul. 2, 2015

(30) Foreign Application Priority Data

Dec. 27, 2013 (KR) ..... 10-2013-00165734

(51) Int. Cl.

| | |
|---|---|
| ***H01F 7/00*** | (2006.01) |
| ***H01H 51/01*** | (2006.01) |
| ***H01F 7/02*** | (2006.01) |
| ***H01F 7/06*** | (2006.01) |

(52) U.S. Cl.

CPC ..... *H01H 51/01* (2013.01); *H01F 7/0289* (2013.01); *H01F 7/066* (2013.01)

(58) Field of Classification Search

CPC ..... H01H 53/015
USPC ..... 335/229, 148
See application file for complete search history.

(56) References Cited

U.S. PATENT DOCUMENTS 5,345,206 A * 9/1994 Morcos ..... H02K 41/0356 310/13
5,745,019 A * 4/1998 Renger ..... A61N 1/3925 335/222
6,373,675 B1 * 4/2002 Yamazaki ..... H01H 53/015 200/237
6,580,345 B2 * 6/2003 Akita ..... H01H 33/285 218/141
6,741,151 B1 * 5/2004 Livshitz ..... H01F 7/066 335/222
6,975,195 B2 * 12/2005 Rausch ..... H01F 7/066 335/220
7,924,127 B2 * 4/2011 Jeong ..... H02K 33/18 310/13
8,531,062 B1 * 9/2013 Eghbal ..... H02K 41/031 310/12.16
2006/0049901 A1 * 3/2006 Bottcher ..... H01F 7/066 335/229
2007/0075810 A1 * 4/2007 Iiduka ..... G01G 7/02 335/229
2011/0257626 A1 * 10/2011 Hunter ..... A61B 17/20 604/503

* cited by examiner

*Primary Examiner* — Alexander Talpalatski
(74) *Attorney, Agent, or Firm* — NSIP Law

(57) ABSTRACT

An electromagnetic force driving device having reduced size and weight, and easily changeable electromagnetic characteristics and holding force, is provided. The device includes: a first housing; a second housing installed under the first housing; a partitioning wall partitioning the first and second housings; a first mover installed on a top of the first housing; a coil unit installed at a lower portion of the second housing to be movable according to a direction of current supplied; a second mover including one end combined with the coil unit, and another end passing through the partitioning wall and connected to the first mover to operate the first mover according to a movement of the coil unit; an upper magnet installed in the first housing to maintain a predetermined position of the first mover; and a lower magnet arranged in the second housing to form a magnetic field at the coil unit.

8 Claims, 10 Drawing Sheets

ELECTROMAGNETIC FORCE DRIVING DEVICE

CROSS-REFERENCE TO RELATED APPLICATIONS

This application claims the benefit under 35 USC §119(a) of Korean Application No. 10-2013-00165734 filed on Dec. 27, 2013 in the Korean Intellectual Property Office, the entire disclosure of which is incorporated herein by reference for all purposes.

BACKGROUND OF THE INVENTION

1. Field of the Invention

The present invention relates to an electromagnetic force driving device, and more specifically, to an electromagnetic force driving device, in which the size and weight can be reduced by combining a magnetic substance and a coil unit through a connection pin inside thereof, and electromagnetic characteristics and a holding force can be easily changed by forming independent motion paths.

2. Background of the Related Art

Generally, a circuit breaker is installed at a sending end or a receiving end of a power transmission line to open and close a normal current when there is no failure in a power system and, in addition, to protect the power system and various power devices (loads) by blocking a fault current when a failure such as a short circuit or the like occurs.

Such a circuit breaker is classified into a Vacuum Circuit Breaker (VCB), an Oil Circuit Breaker (OCB), a Gas Circuit Breaker (GCB) and the like according to an extinguishing/insulating material.

When the circuit breaker blocks the fault current, arcs generated between two contacting points should be extinguished, and the gas circuit breaker is classified again into a Puffer type, a Rotating arc type, a Thermal expansion type, a Hybrid extinction type and the like according to a method of extinguishing the arcs.

In such a circuit breaker, an opening operation should be accomplished at a high speed in order to block the failure current and promptly recover insulation between electrodes, and, for example, a high voltage/extra high voltage (generally, 365 kv or higher) circuit breaker for power transmission has a stroke length (SL) of about 250 mm and requires a force and a speed as large as to complete the operation within an extremely short time of 45 ms (milliseconds).

Although a hydraulic or pneumatic actuator is chiefly used as a high voltage/extra high voltage circuit breaker at present, there is a problem in that such an actuator is very expensive as much as one third of a total price of the circuit breaker, and, in Korean, most of actuators are imported.

Furthermore, in such a hydraulic or pneumatic actuator, working fluid may be leaked according to changes in the temperature of surrounding areas, and since the actuator is configured of a lot of parts, it is worried that the actuator may not operate if any one of the parts is out of order.

Accordingly, studies on development of actuators for substituting hydraulic or pneumatic actuators are under progress, and a spring actuator (a spiral spring), a motor drive (a system for converting a rotation motion into a linear motion using a motor), and a permanent magnetic actuator (PMA) are representatively used as results of the studies.

However, since the spring actuator is a system for obtaining power by releasing a compressed force when needed while a spring is compressed, its manufacturing cost is low. However, it is disadvantageous in that reliability of an operation state is low since elastic force of the spring is inconsistent. Therefore, it is difficult to apply the spring actuator to a high voltage/extra high voltage in which extinction gas should be sprayed, and, in addition, probability of failing the cutoff will be very high.

In addition, although manufacturing cost of the motor drive is low compared with that of the hydraulic or pneumatic actuator, since it is still expensive and difficult to generate a high power, the motor drive can be used for a low voltage, but may not exhibit sufficient performance at a high or extra high voltage.

In addition, the PMA actuator is formed to operate a mover using an electromagnetic force caused by a magnetic force generated by a permanent magnet and a magnetic field generated by flowing current through a coil, and since the PMA actuator is advantageous in that it has a simple structure and a good actuating efficiency and a consistent and uniform operation can be expected, it is frequently used as an actuator for a low voltage circuit breaker recently.

However, since the PMA actuator is a system which should be driven by a magnetic force generated by a permanent magnet and a magnetic force generated by flowing current through a coil, a path for flowing the magnetic field should be prepared using a magnetic substance (an iron core), and, in addition, the driven mover also should be formed of a magnetic substance.

Accordingly, when the breaking capacity is increased and thus the actuator needs a more powerful force, more magnetic fields should be generated, and the magnetic substance also should be increased as much as to flow the magnetic fields without being saturated, and thus the burden on the size of the actuator is increased, and since magnetic flux densities excited at the permanent magnet and the coil are inverse proportional to the square of an air gap length, there is a limit in applying the PMA actuator to a high voltage or extra high voltage circuit breaker having a large contact gap of a breaking unit, and thus there is a problem in that when the PMA actuator is used for an extra high voltage, its size should be much bigger, and its weight is much heavier than that of a hydraulic or pneumatic actuator, and, in addition, manufacturing cost is also increased.

Recently, an actuator such as an electromagnetic circuit breaker or an Electro-Magnetic Force Driving Actuator (EMFA) have been proposed in Korea Patent Registration No. 10-0718927 (title of the invention: Actuator using electromagnetic force and circuit breaker using thereof) to maximize the actuating speed and force while having a small size and weight to solve the problems of the circuit breakers.

Such an electromagnetic circuit breaker is a kind of circuit breaker having a structure of providing inner and outer hollow containers formed of a magnetic substance, arranging inner and outer permanent magnets on the facing surfaces of the inner and outer containers, and arranging a coil and a mover of a non-magnetic substance operating together with the coil as one piece between the inner permanent magnet and the outer permanent magnet, and thus when a current is supplied to the coil, the coil and the mover linearly move in the axis direction between the inner permanent magnet and the outer permanent magnet by an electromagnetic repulsion force generated by the magnetic field of the inner and outer permanent magnets and the current density of the coil.

However, in such an electromagnetic circuit breaker (EMFA), since the coil is arranged inside the enclosed outer container, it is difficult to connect an electric wire inside the outer container to supply current to the coil.

In addition, although the wire is connected, since the connected wire moves in the axis direction according to the linear motion of the coil, there is a problem of open circuit since the moving speed of the coil is too high and thus the electric wire is fatigued by compression and tension.

In addition, since a conventional electromagnetic circuit breaker has a mover arranged inside the enclosed hollow inner and outer containers, a moving axis or a connection axis should be extended long from the mover in the axis direction in order to connect the mover to an external movement element, and, in addition, the length of the extension should be long enough to sufficiently secure a stroke distance of the mover.

In addition, since increase of the length leads to increase of the overall height occupied by the circuit breaker, and the number of the connection axis or the moving axis should be increased or a connection axis or a moving axis of a large diameter should be used considering strength of the connection axis or the moving axis, there is a problem in that the overall weight of the circuit breaker is increased.

In addition, since the conventional circuit breaker has a coil unit and a magnetic substance formed in one piece, there is a problem in that electromagnetic characteristics and a holding force for maintaining a top or bottom dead point state cannot be changed according to an installation environment.

SUMMARY OF THE INVENTION

Therefore, the present invention has been made in view of the above problems, and it is an object of the present invention to provide an electromagnetic force driving device, in which the size and weight can be reduced by combining a magnetic substance and a coil unit through a connection pin inside thereof, and electromagnetic characteristics and a holding force can be easily changed by forming independent motion paths.

To accomplish the above object, according to one aspect of the present invention, there is provided an electromagnetic force driving device comprising: a housing 210 or 210' including a first housing 210*a* in which a first mover 220 is installed, a second housing 210*b* in which a coil unit 230 is installed, a third housing 210*c* installed on a bottom surface of the second housing 210*b*, and a fourth housing 210*d* for partitioning the first housing 210*a* and the second housings 210*b*; a first mover 220 installed on a top of the first housing 210*a* to be movable in a vertical direction; a coil unit 230 installed in parallel to the second housing 210*b* to move either upwards or downwards by a repulsive force according to a direction of current supplied in a forward direction or a reverse direction; a second mover 240, one end of which is combined with the coil unit 230, and the other end of which passes through the fourth housing 210*d* to be connected to the first mover 220, to operate the first mover 220 according to a movement of the coil unit 230; an upper magnet 250 installed in the first housing 210*a* to be tightly attached to the first mover 220 to provide a magnetic force for the first mover 220 to maintain either a top dead point or a bottom dead point; and a lower magnet 260 installed in the second housing 210*b* to form a magnetic field using the coil unit 230.

In addition, the second housing 210*b* according to the present invention includes: a first non-magnetic substance 270 installed between the fourth housing 210*d* and the lower magnet 260; and a second non-magnetic substance 271 installed between the lower magnet 260 and the third housing 210*c*.

In addition, the first mover 220 according to the present invention includes: a first mover lower body 221 connected to a bottom surface of a body of the first mover 220 through a first mover link 221*a*; a first attaching unit 220*a* protruded from the body of the first mover 220 by a certain thickness to be tightly attached to the upper magnet 250 through a magnetic field; and a second attaching unit 221*b* protruded from the first mover lower body 221 by a certain thickness to be tightly attached to the upper magnet 250 through a magnetic field.

In addition, the upper magnet 250 according to the present invention further includes: a first magnetic substance 251 installed at both sides of a body of the upper magnet 250 to form a path of a magnetic field; and a first non-magnetic substance 252 having a first mover link penetration hole 252*a* formed for the first mover link 220*a* to pass through and preventing a magnetic field formed by the upper magnet 250 and the first magnetic substance 251 from being formed at the first housing 210*a*.

In addition, the electromagnetic force driving device according to the present invention further comprises: a supporting housing 210*e* installed under the third housing 210*c* of the housing 210'; a first supporting mover 220' installed under the supporting housing 210*e* to be movable in a vertical direction; a second supporting mover 240', one end of which is combined with the coil unit 230, and the other end of which passes through the third housing 210*c* to be connected to the first supporting mover 220', to operate the first supporting mover 220' according to a movement of the coil unit 230; and a supporting magnet 250' installed in the supporting housing 210*e* to be tightly attached to the first supporting mover 220' to provide a magnetic field for the first supporting mover 220' to maintain either the top dead point or the bottom dead point.

In addition, the first supporting mover 220' according to the present invention includes: a first supporting mover lower body 221' connected to a bottom surface of a body of the first supporting mover 220' through a first supporting mover link 221*a'*; a first supporting attaching unit 220*a'* protruded from the body of the first supporting mover 220' by a certain thickness to be tightly attached to the supporting magnet 250' through a magnetic field; and a second supporting attaching unit 221*b'* protruded from the first supporting mover lower body 221' by a certain thickness to be tightly attached to the supporting magnet 250' through a magnetic field.

In addition, the supporting magnet 250' according to the present invention further includes: a first supporting magnetic substance 251' installed at both sides of a body of the supporting magnet 250' to form a path of a magnetic field; and a first supporting non-magnetic substance 252' having a first supporting mover link penetration hole 252*a'* formed for the first supporting mover link 220*a'* to pass through and preventing a magnetic field formed by the supporting magnet 250' and the first supporting magnetic substance 251' from being formed at the supporting housing 210*e*.

In addition, the first housing 210*a* and the supporting housing 210*e* according to the present invention are arranged to be parallel or perpendicular to a length direction of the coil unit 230 of the second housing 210*b*.

The present invention is advantageous in that when an error occurs in a power distribution and transmission line, it can be promptly cut off, and the overall weight and size can be reduced by simplifying the structure of the electromagnetic force driving device by combining a magnetic substance and a coil unit through a connection pin inside thereof.

In addition, the present invention is advantageous in that electromagnetic characteristics and a holding force can be easily changed by forming independent motion paths for moving the mover and the coil unit.

DESCRIPTION OF SYMBOLS

Figure 1:
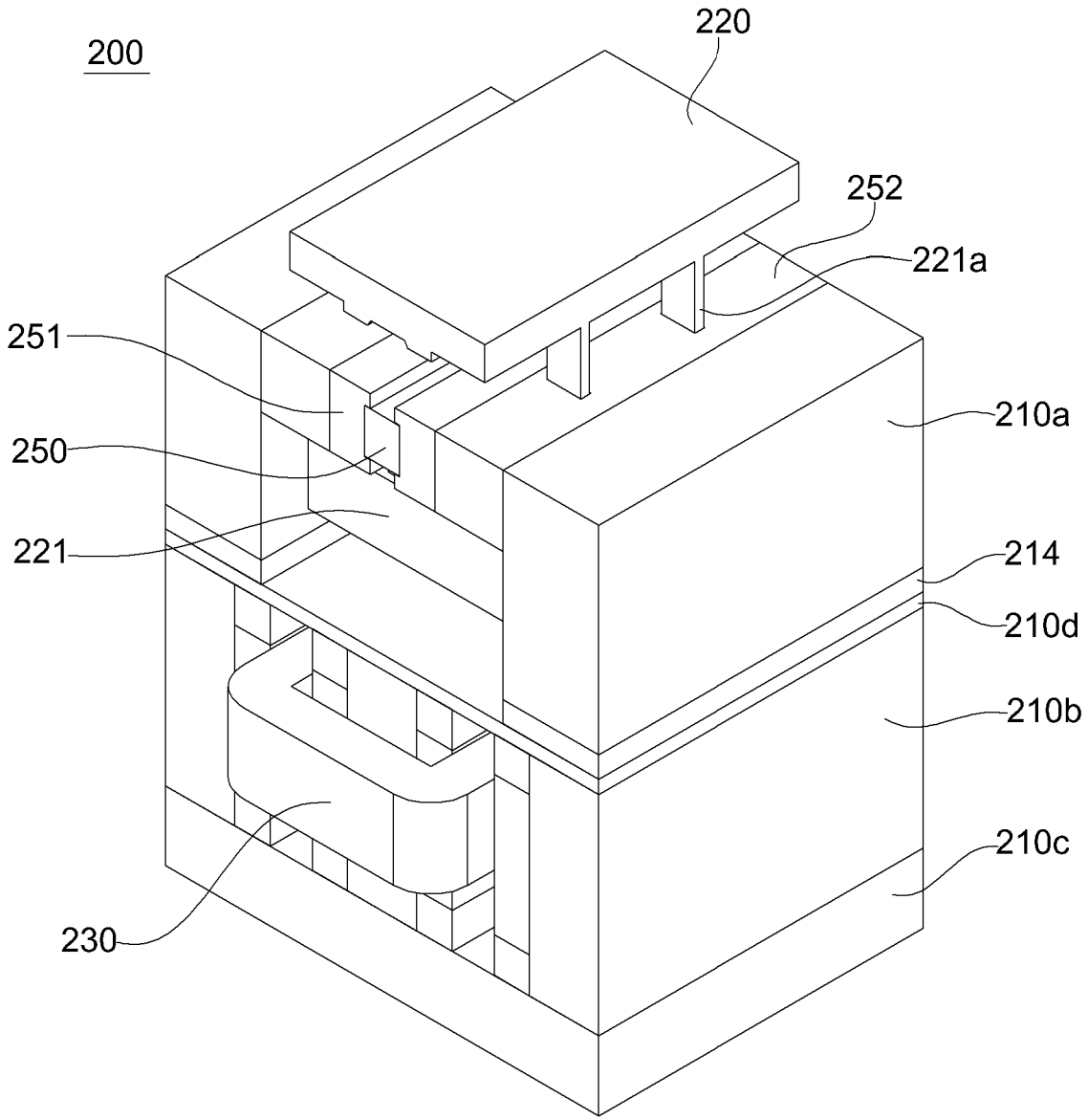
FIG. 1 is a perspective view showing a first embodiment of an electromagnetic force driving device according to the present invention.

200, 200', 400, 400': Electromagnetic force driving device
210, 210', 410, 410': Housing
220, 420: First mover
220', 420': First supporting mover
230, 430: Coil unit
240, 440: Second mover
240', 440': Second supporting mover
250', 450: Upper magnet
260, 460: Lower magnet
270, 470: First non-magnetic substance
271, 471: Second non-magnetic substance

DETAILED DESCRIPTION OF THE PREFERRED EMBODIMENT

Hereafter, preferred embodiments of an electromagnetic force driving device according to the present invention will be described in detail with reference to the accompanying drawings.

First Embodiment

Figure 2:
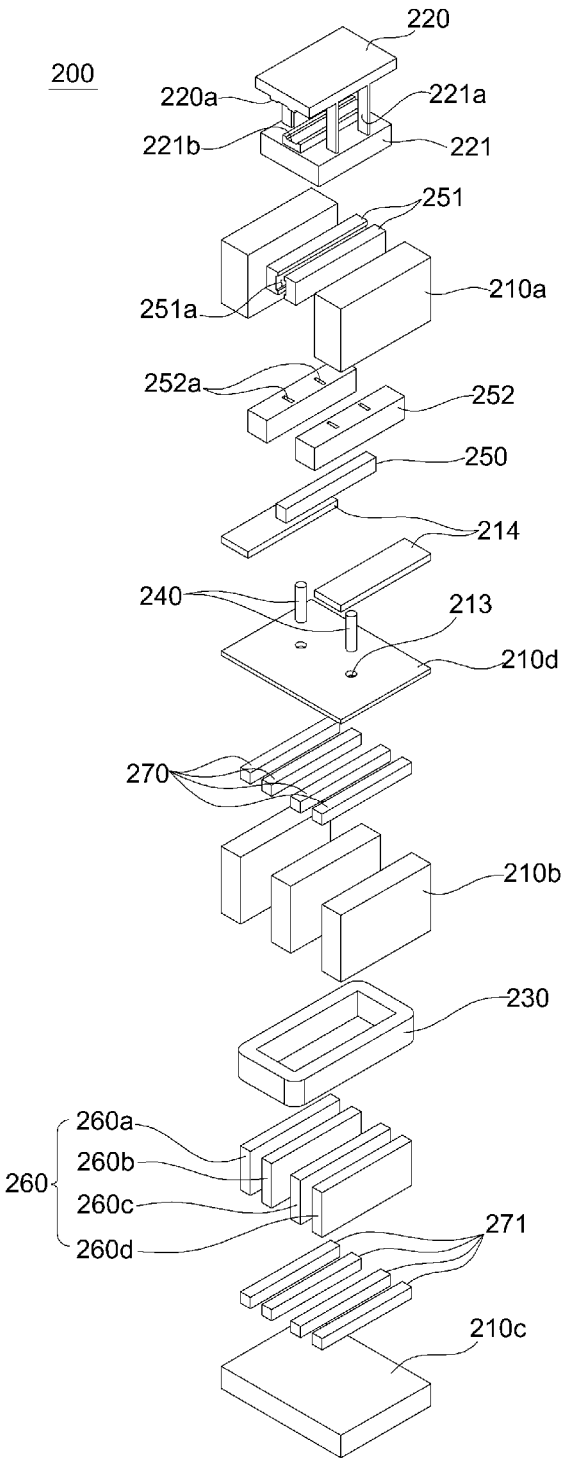
FIG. 2 is an exploded perspective view showing the configuration of the electromagnetic force driving device according to FIG. 1.
Figure 3:
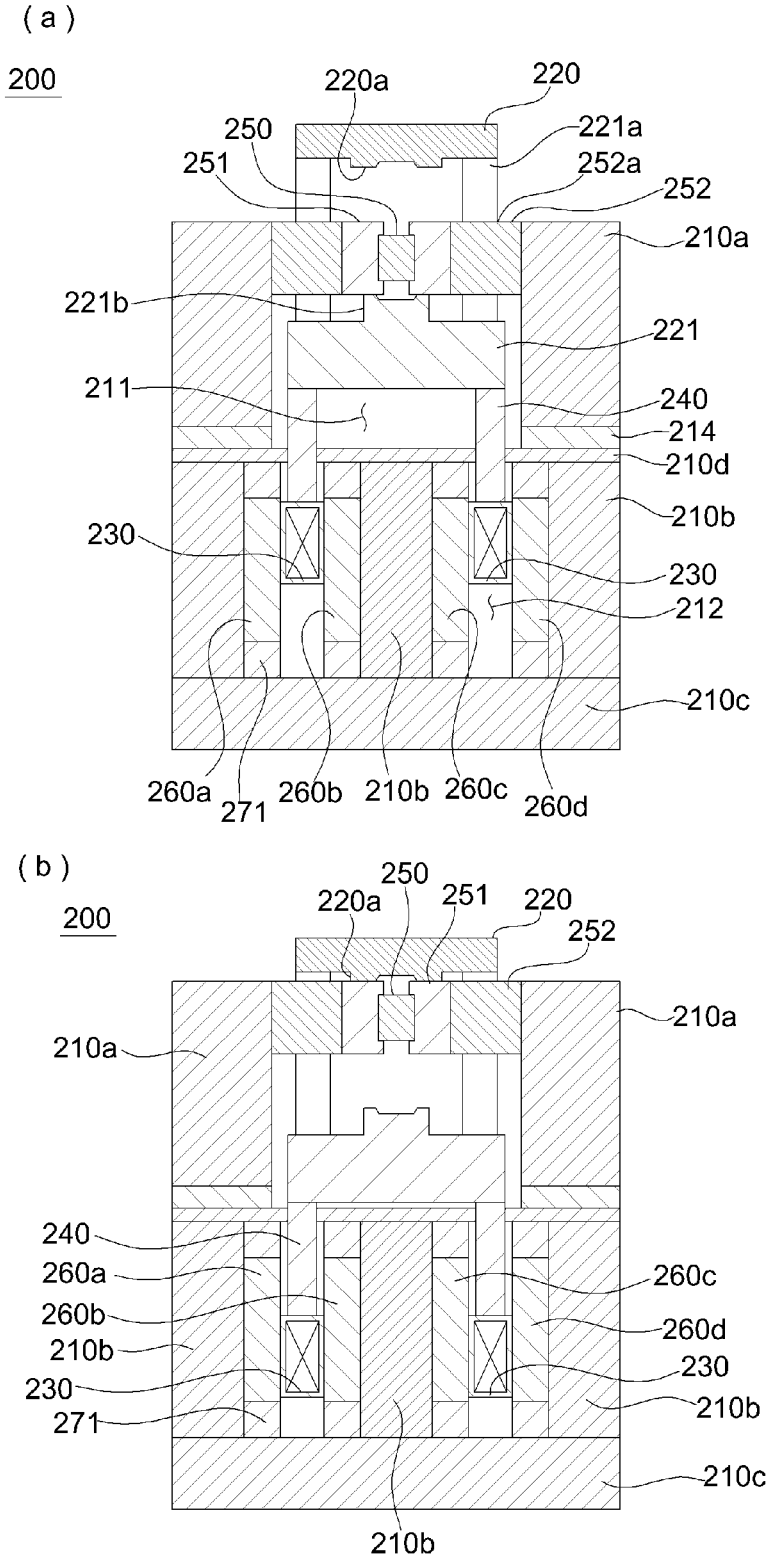
FIG. 3 is a cross-sectional view showing the structure and operation of the electromagnetic force driving device according to FIG. 1.

FIG. 1 is a perspective view showing a first embodiment of an electromagnetic force driving device according to the present invention, FIG. 2 is an exploded perspective view showing the configuration of the electromagnetic force driving device according to FIG. 1, and FIG. 3 is a cross-sectional view showing the structure and operation of the electromagnetic force driving device according to FIG. 1.

As shown in FIGS. 1 to 3, an electromagnetic force driving device 200 according to a first embodiment is configured to include a housing 210, a first mover 220, a coil unit 230, a second mover 240, an upper magnet 250 and a lower magnet 260.

The housing 210 is a magnetic substance configured to include a first housing 210*a*, a second housing 210*b*, a third housing 210*c* and a fourth housing 210*d*. The first housing 210*a* forms a structure in which side walls are installed at both sides, and both sides of the first housing 210*a*, as well as the top side thereof, are open in the length direction.

In addition, a first mover 220 and an upper magnet 250 are installed in the first housing 210*a*, and a first motion path 211 along which the first mover 220 moves is formed inside the first housing 210*a*.

The second housing 210*b* is installed under the first housing 210*a* to be separated by the fourth housing 210*d*, and a second motion path 212 for moving the coil unit 230 is formed inside thereof.

The third housing 210*c* is installed under the second housing 210*b* to support the lower magnet 260, a first non-magnetic substance 270 and a second non-magnetic substance 271 installed in the second housing 210*b*, and the second and third housings 210*b* and 210*c* are preferably formed of a magnetic substance.

The fourth housing 210*d* is installed between the first housing 210*a* and the second housing 210*b* to partition the first and second housings 210*a* and 210*b*, and a non-magnetic substance 214 may be installed between the first housing 210*a* and the fourth housing 210*d*.

The first mover 220 is installed on the top of the first housing 210*a* to be movable in the vertical direction and fixed to the first housing 210*a* to be selectively positioned at the top dead point or the bottom dead point, and a first mover lower body 221 of a plate shape moving along the first motion path 211 of the first housing 210*a* is spaced apart from the first mover 220 by a certain distance under the first mover 220 of a plate shape and connected to the first mover 220 through a first mover link 221*a*.

In addition, the first mover 220 is protruded from the bottom surface of the body of the first mover 220 by a certain thickness to form a first attaching unit 220*a*, and if the first mover 220 moves downwards, the first mover 220 forms a magnetic field together with the upper magnet 250 so that the first mover 220 may maintain a state of being tightly attached to the first housing 210*a*.

In addition, the first mover lower body 221 is protruded from the top surface of the first mover lower body 221 by a certain thickness to form a second attaching unit 221*b*, and if the first mover lower body 221 moves upwards, the first mover lower body 221 forms a magnetic field together with the upper magnet 250 so that the first mover lower body 221 may maintain a state of being tightly attached to the first housing 210*a*.

In addition, the first mover 220 and the first mover lower body 221 are configured of a magnetic substance to form a magnetic force together with the upper magnet 250 to be fixed at a predetermined position.

The coil unit 230 is a configuration installed inside the second housing 210*b* to be movable in the vertical direction and providing a driving force so as to move in a direction perpendicular to the magnetic field of the lower magnet 260 (either upwards or downwards in the figure) by a magnetic flux density generated by the lower magnet 260, a density of current supplied to the coil unit 230 and an electromagnetic repulsive force according to a direction of current supplied in a forward or reverse direction, and it is configured to be wound (wrapped) with a conductive wire in an approximate oval shape so that, for example, current may flow in a forward direction of flowing clockwise from the left to the right or in a reverse direction of flowing counterclockwise from the right to the left in the figure.

The coil unit 230 is installed to penetrate the second housing 210*b* in the lateral direction, and the second mover 240 is installed on the coil unit 230 so that operation of the coil unit 230 can be performed together with the first mover 220.

The second mover 240 is a pipe shaped member, in which one end is combined with the top of the coil unit 230, and the other end passes through the second mover penetration hole 213 of the fourth housing 210*d* to be connected to the first mover 220, to operate the first mover 220 to move in the vertical direction according to the vertical movement of the coil unit 230.

The upper magnet 250 is a bar shaped permanent magnet tightly attached to either the first mover 220 or the first mover lower body 221 to form a magnetic field for moving the first mover 220 upwards and maintaining a top dead point or to form a magnetic field for moving the first mover 220 downwards and maintaining a bottom dead point where the first mover 220 is tightly attached to the top surface of the first housing 210*a* and thus provides a holding force (magnetic force) so that the first mover 220 may maintain either the top dead point or the bottom dead point.

In addition, a first magnetic substance 251 is installed at both sides of the upper magnet 250 to provide a large holding force with a small size (area or volume) and may provide an appropriate holding force to the first mover 220 or the first mover lower body 221 according to the usage of installation by freely changing the size of the upper magnet 250.

The first magnetic substance 251 is installed at both sides of the upper magnet 250 so that the upper magnet 250 may be fixed to the first housing 210*a*, has a magnet installation groove 251*a* formed in the length direction to insert the upper magnet 250, and forms a magnetic circuit together with the first mover 220 or the first mover lower body 221 through the magnetic field formed by the upper magnet 250.

Meanwhile, a non-magnetic substance 252 is installed between the first magnetic substance 251 and the first housing 210*a* to prevent the magnetic field formed by the upper magnet 250 and the first magnetic substance 251 from being formed at the first housing 210*a* which is a magnetic substance, and a first mover link penetration hole 252*a* is formed so that the first mover link 221*a* which connects the first mover 220 and the first mover lower body 221 may pass through.

The lower magnet 260 is a configuration installed inside the second housing 210*b* to form a magnetic field around the coil unit 230, in which a first lower magnet 260*a*, a second lower magnet 260*b*, a third lower magnet 260*c* and a fourth lower magnet 260*d* are sequentially arranged around the coil unit 230 and form a magnetic field to generate a repulsive force for moving the coil unit 230 upwards or downwards according to a direction of current supplied to the coil unit 230.

In addition, the first non-magnetic substance 270 and the second non-magnetic substance 271 are installed above and below the first to fourth lower magnets, respectively, between the first to fourth lower magnets 260*a*, 260*b*, 260*c* and 260*d* and the fourth housing 210*d* and between the first to fourth lower magnets 260*a*, 260*b*, 260*c* and 260*d* and the third housing 210*c* to form a magnetic path by maintaining a distance, and N poles and S poles of the first to fourth lower magnets 260*a*, 260*b*, 260*c* and 260*d* are sequentially arranged inside the second housing 210*b* centering on the coil unit 230 so that a magnetic field may be formed in a predetermined direction.

If the first to fourth lower magnets 260*a*, 260*b*, 260*c* and 260*d* are arranged as described above and a forward or reverse current flows through the coil unit 230, the coil unit 230 is moved in a direction perpendicular to the magnetic field, i.e., upwards or downwards, by a force generated by the Fleming's left hand rule based on the magnetic density generated by the first to fourth magnets 260*a*, 260*b*, 260*c* and 260*d*, current density of the coil unit 230 and the repulsive force according to the direction of the current.

The first non-magnetic substance 270 is installed between the fourth housing 210*d* and the lower magnet 260, and the second non-magnetic substance 271 is installed between the lower magnet 260 and the third housing 210*c* so that a magnetic path may be formed around the coil unit 230.

Next, the operation procedure of the electromagnetic force driving device 200 according to a first embodiment of the present invention will be described.

(Supply of Forward Current)

When the first mover 220 is positioned at the top dead point protruded above the first housing 210*a*, a magnetic field is formed between the upper magnet 250 and the first mover lower body 221, and the first mover 220 maintains a state of being positioned at the top dead point.

Then, if a forward current is supplied to the coil unit 230, the coil unit 230 moves downwards due to the electromagnetic force caused by the electric field generated by the coil unit 230 and the magnetic field generated by the lower magnet 260, and the first mover 220 also moves downwards by the second mover 240 combined with the coil unit 230.

If the forward current supplied to the coil unit 230 is cut off, a magnetic field is generated between the first mover 220 and the upper magnet 250, and thus the first mover 220 is held at the bottom dead point where the first mover 220 is tightly attached to the first housing 210*a*, through a magnetic force generated by the magnetic field.

(Supply of Reverse Current)

When the first mover 220 is positioned at the bottom dead point where the first mover 220 is tightly attached to the top surface of the first housing 210*a*, the first mover 220 maintains the bottom dead point through a holding force generated by the magnetic field between the upper magnet 250 and the first mover 220.

Then, if a reverse current is supplied to the coil unit 230, the coil unit 230 moves upwards due to the electromagnetic force caused by the electric field generated by the coil unit 230 and the magnetic field generated by the lower magnet 260, and the first mover 220 also moves upwards by the second mover 240 combined with the coil unit 230.

If the reverse current supplied to the coil unit 230 is cut off, a magnetic field is generated between the first mover lower body 221 and the upper magnet 250, and thus the first mover 220 moves to the top dead point above the first housing 210*a* and is held through a magnetic force generated by the magnetic field and.

Second Embodiment

Figure 4:
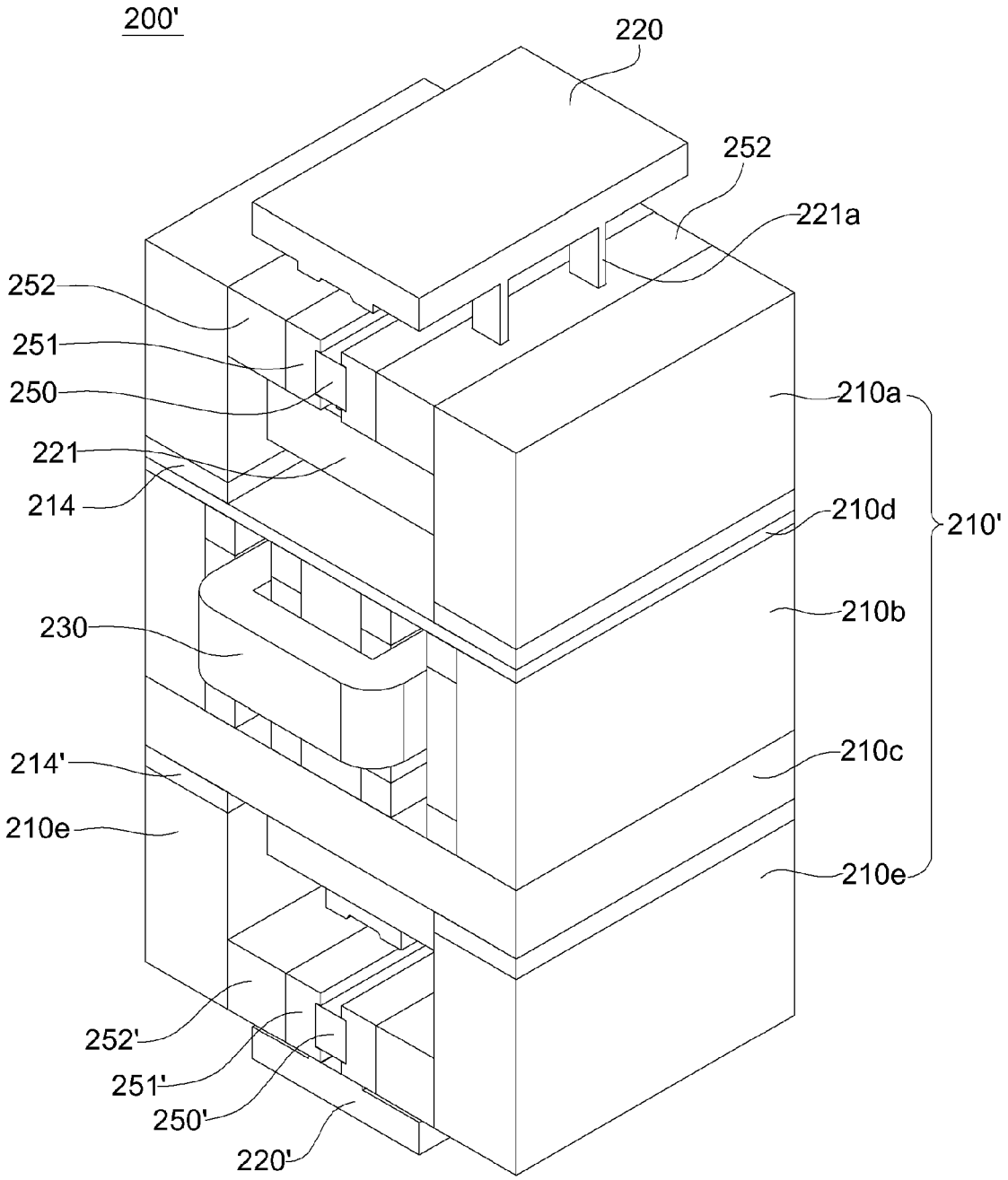
FIG. 4 is a perspective view showing a second embodiment of an electromagnetic force driving device according to the present invention.
Figure 5:
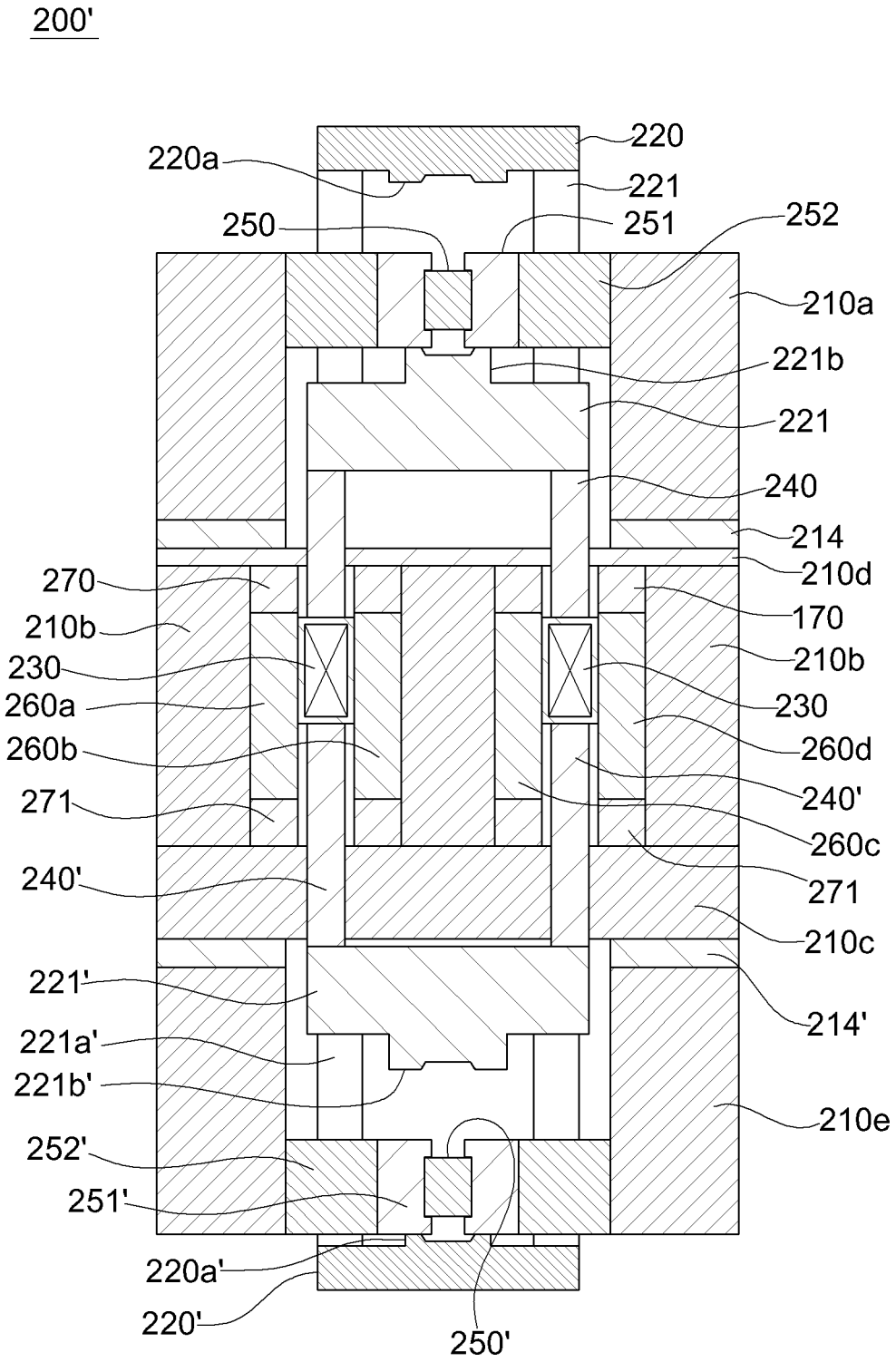
FIG. 5 is a cross-sectional view showing the structure of the electromagnetic force driving device according to FIG. 4.

FIG. 4 is a perspective view showing a second embodiment of an electromagnetic force driving device according to the present invention, and FIG. 5 is a cross-sectional view showing the structure of the electromagnetic force driving device according to FIG. 4.

Repeated descriptions of the elements the same as those of the first embodiment are omitted, and like numerals are used for like elements of the first embodiment, and characteristic elements of a second embodiment will be described.

As shown in FIGS. 4 and 5, the electromagnetic force driving device 200' according to a second embodiment of the present invention is configured to include a housing 210, a first mover 220, a first supporting mover 220', a coil unit 230, a second mover 240, a second supporting mover 240', an upper magnet 250, a supporting magnet 250', a lower magnet 260, a first non-magnetic substance 270 and a second non-magnetic substance 271.

The housing 210' is a magnetic substance configured to include a first housing 210*a*, a second housing 210*b*, a third housing 210*c*, a fourth housing 210*d*, and a supporting housing 210*e*.

The supporting housing 210*e* is installed in a direction opposite to the first housing 210*a* from the second housing 210*b*, separated from the second housing 210*b* through the third housing 210*c*, and configured in a shape the same as the first housing 210*a* of the third embodiment, and a non-magnetic substance 214' may be installed between the third housing 210*c* and the supporting housing 210*e*.

In addition, a first supporting mover 220' and a supporting magnet 250' are installed in the supporting housing 210*e*, and a motion path for moving the first supporting mover 220' is formed inside the supporting housing 210*e*.

The first supporting mover 220' is a magnetic substance installed on the bottom of the supporting housing 210*e* to be movable in the vertical direction and fixed to the supporting housing 210*e* to be selectively positioned at the top dead point or the bottom dead point, and a first supporting mover lower body 221' of a plate shape moving along the motion path of the supporting housing 210*e* is spaced apart from the first supporting mover 220' by a certain distance under the plate shaped first supporting mover 220' and connected to the first supporting mover 220' through a first supporting mover link 221*a'*.

In addition, the first supporting mover 220' is protruded from the body of the first supporting mover 220' by a certain thickness to form a first supporting attaching unit 220*a'*, and if the first supporting mover 220' moves upwards, the first supporting mover 220' forms a magnetic field together with the supporting magnet 250' and maintains a state of being tightly attached to the supporting housing 210*e*.

In addition, the first supporting mover lower body 221' is protruded from the bottom surface of the first supporting mover lower body 221' by a certain thickness to form a second supporting attaching unit 221*b'*, and if the first supporting mover lower body 221' moves downwards, the first supporting mover lower body 221' forms a magnetic field together with the supporting magnet 250' so that the first supporting mover lower body 221' may maintain a state of being tightly attached to the supporting housing 210*e*.

In addition, the first supporting mover 220' and the first supporting mover lower body 221' are configured of a magnetic substance to form a magnetic field together with the supporting magnet 250' to be fixed at the top dead point or the bottom dead point.

The second supporting mover 240' is a pipe shaped member, in which one end is combined with the bottom of the coil unit 230, and the other end passes through the third housing 210*c* to be connected to the first supporting mover 220', to operate the first supporting mover 220' to move in the vertical direction according to the vertical movement of the coil unit 230.

The supporting magnet 250' is a bar shaped permanent magnet tightly attached to either the first supporting mover 220' or the first supporting mover lower body 221' to form a magnetic field for moving the first supporting mover 220' upwards and maintaining the top dead point or to form a magnetic field for moving the first supporting mover 220' downwards and maintaining the bottom dead point where the first supporting mover 220' is tightly attached to the supporting housing 210*e* and thus provides a holding force (magnetic force) so that the first supporting mover 220' may maintain either the top dead point or the bottom dead point.

In addition, a first supporting magnetic substance 251' is installed at both sides of the supporting magnet 250' to provide a large holding force with a small size (area or volume) and may provide an appropriate holding force to the first supporting mover 220' or the first supporting mover lower body 221' according to the usage of installation by freely changing the size of the supporting magnet 250'.

The first supporting magnetic substance 251' is installed at both sides of the supporting magnet 250' so that the supporting magnet 250' may be fixed to the supporting housing 210*e*, has a magnet installation groove formed in the length direction to insert the supporting magnet 250', and forms a magnetic circuit together with the first supporting mover 220' or the first supporting mover lower body 221' through the magnetic field formed by the supporting magnet 250'.

Meanwhile, a supporting non-magnetic substance 252' is installed between the first supporting magnetic substance 251' and the supporting housing 210*e* to prevent the magnetic field formed by the supporting magnet 250' and the first supporting magnetic substance 251' from being formed at the supporting housing 210*e* which is a magnetic substance, and a first supporting mover link penetration hole is formed so that the first supporting mover link 221*a'* which connects the first supporting mover 220' and the first supporting mover lower body 221' may pass through.

Accordingly, if a forward current is supplied to the coil unit 230, the coil unit 230 moves downwards due to the electromagnetic force caused by the electric field generated by the coil unit 230 and the magnetic field generated by the lower magnet 260, and the first mover 220 and the first supporting mover 220' also move downwards by the second mover 240 and the second supporting mover 240' combined with the coil unit 230. If the forward current supplied to the coil unit 230 is cut off, a magnetic field is generated between the first mover 220 and the upper magnet 250, and thus the first mover 220 is held at the bottom dead point where the first mover 220 is tightly attached to the first housing 210*a*, through a magnetic force generated by the magnetic field, and held at the top dead point where the first supporting mover 220' is tightly attached to the supporting housing 210*e* by the magnetic field generated between the first supporting mover lower body 221' and the supporting magnet 250', through a magnetic force generated by the magnetic field.

Then, if a reverse current is supplied to the coil unit 230, the first mover 220 and the first supporting mover 220' move upwards by a repulsive force generated by the electromagnetic force and held at the top dead point and the bottom dead point respectively through a magnetic force generated by the upper magnet 250 and the supporting magnet 250'.

Third Embodiment

Figure 6:
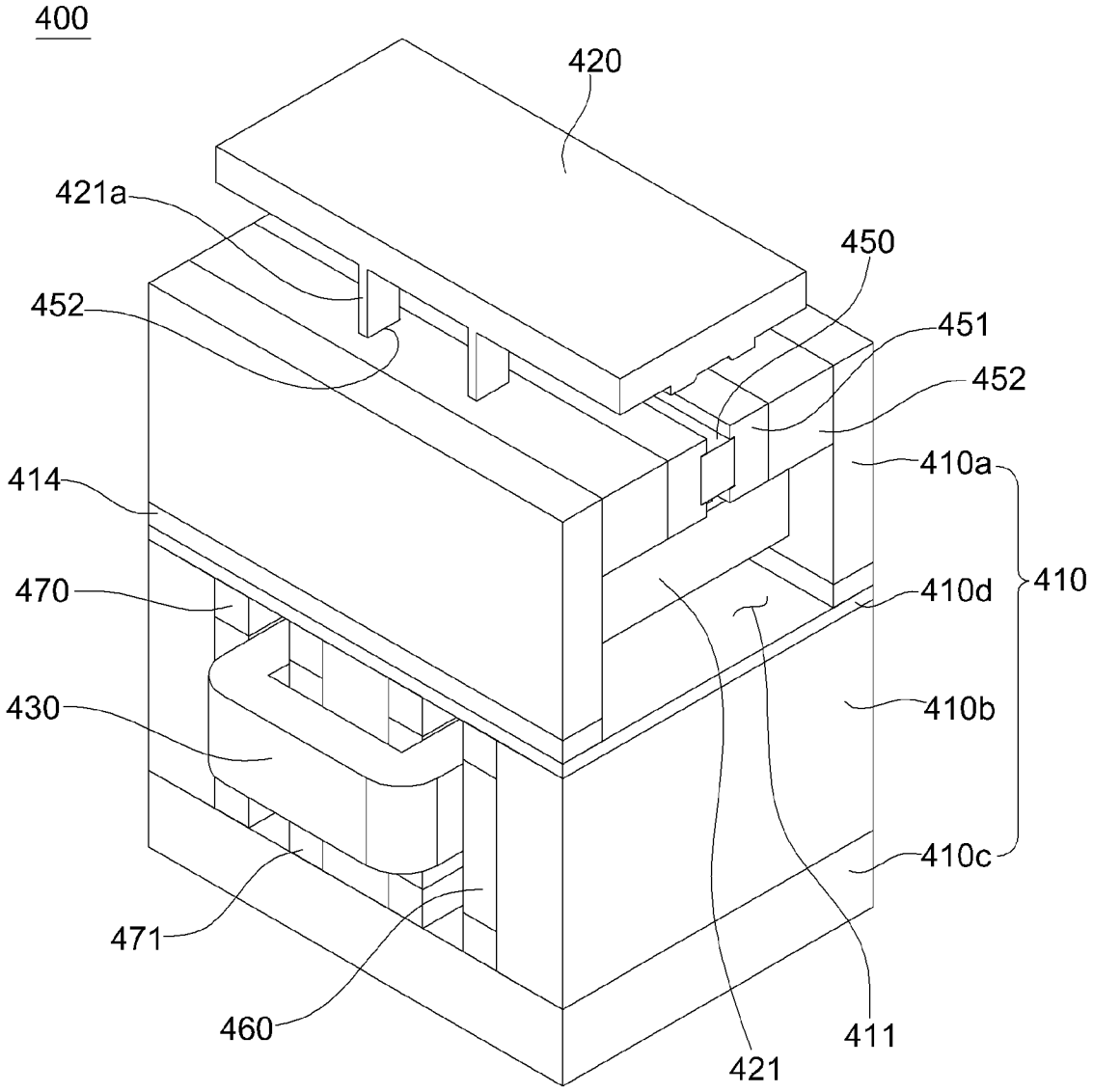
FIG. 6 is a perspective view showing a third embodiment of an electromagnetic force driving device according to the present invention.
Figure 7:
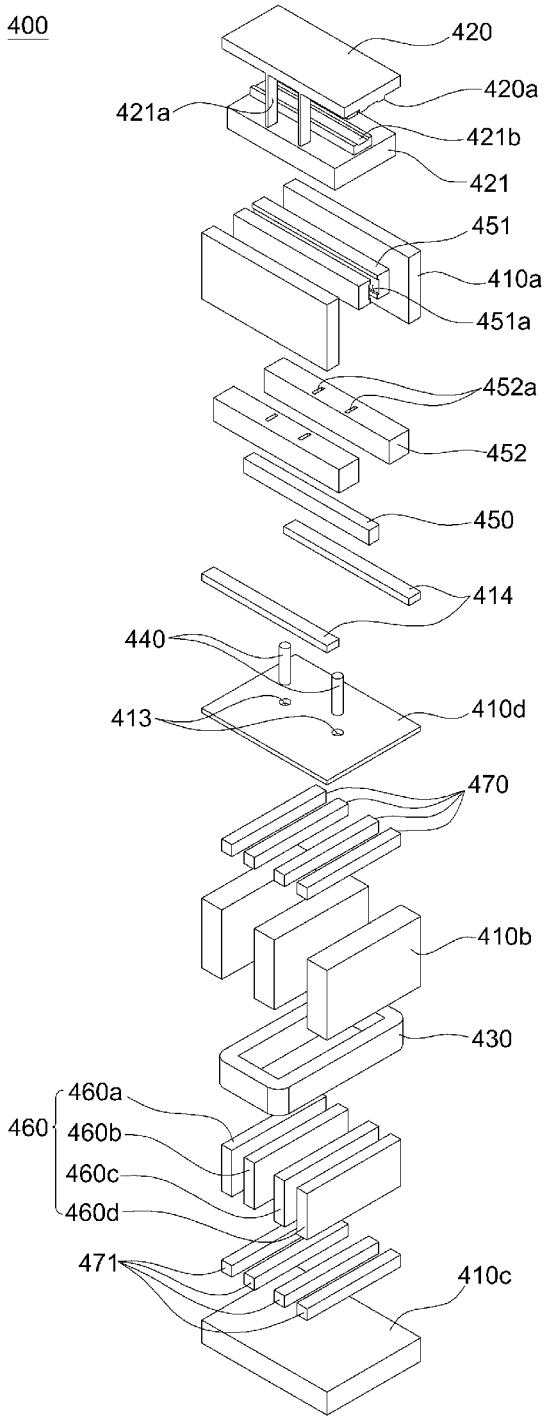
FIG. 7 is an exploded perspective view showing the configuration of the electromagnetic force driving device according to FIG. 6.
Figure 8:
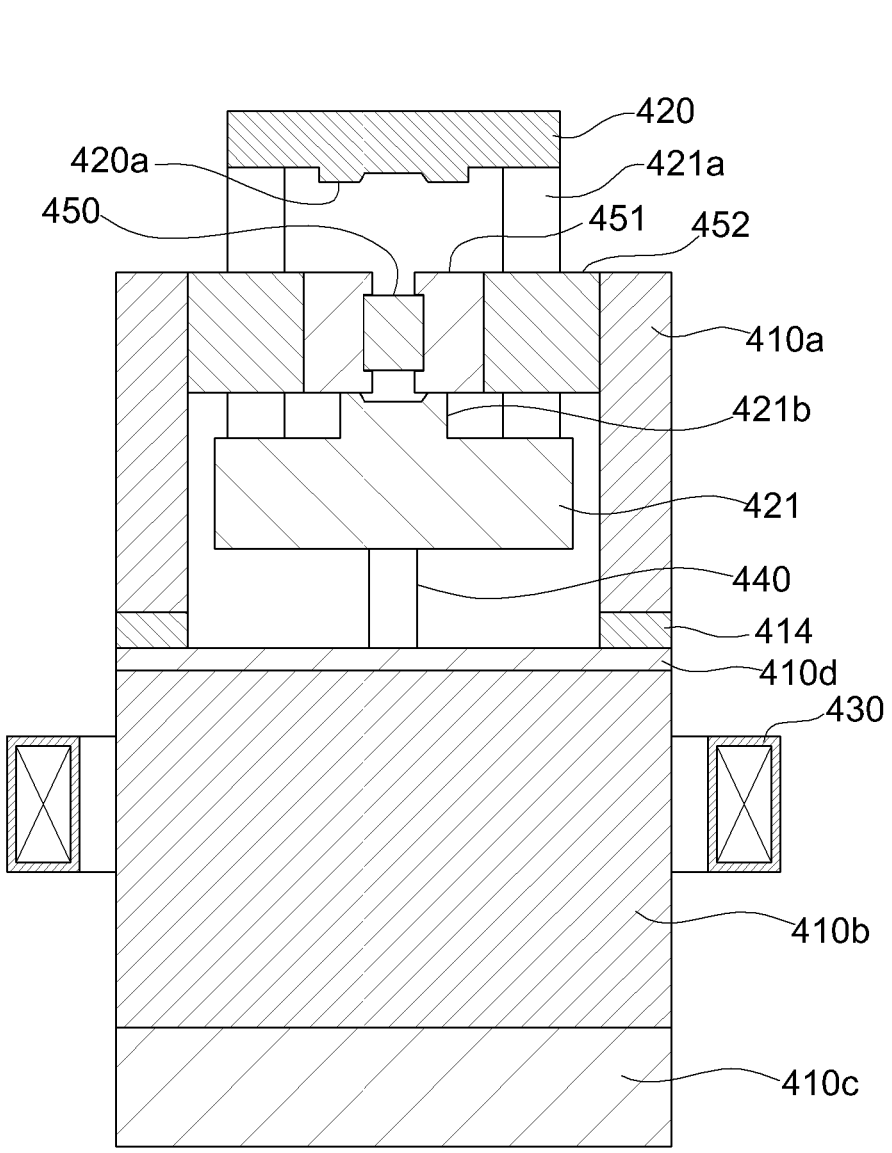
FIG. 8 is a cross-sectional view showing the structure of the electromagnetic force driving device according to FIG. 6.

FIG. 6 is a perspective view showing a third embodiment of an electromagnetic force driving device according to the present invention, FIG. 7 is an exploded perspective view showing the configuration of the electromagnetic force driving device according to FIG. 6, and FIG. 8 is a cross-sectional view showing the structure of the electromagnetic force driving device according to FIG. 6.

As shown in FIGS. 6 to 8, an electromagnetic force driving device 400 according to a third embodiment is configured to include a housing 410, a first mover 420, a coil unit 430, a second mover 440, an upper magnet 450 and a lower magnet 460.

The housing 410 is a magnetic substance configured to include a first housing 410*a*, a second housing 410*b*, a third housing 410*c*, and a fourth housing 410*d*. The first housing 410*a* forms a structure in which side walls are installed at both sides, and both sides of the first housing 410*a*, as well as the top side thereof, are open in the length direction.

In addition, a first mover 420 and an upper magnet 450 are installed in the first housing 410*a*, and a first motion path 411 along which the first mover 420 moves is formed inside the first housing 410*a*.

The second housing 410*b* is installed under the first housing 410*a* to be separated by the fourth housing 410*d*, and a second motion path 412 for moving the coil unit 430 is formed inside thereof.

The third housing 410*c* is installed under the second housing 410*b* to support the lower magnet 460, a first non-magnetic substance 470 and a second non-magnetic substance 471 installed in the second housing 410*b*, and the second and third housings 410*b* and 410*c* are preferably formed of a magnetic substance.

The fourth housing 410*d* is installed between the first housing 410*a* and the second housing 410*b* to partition the first and second housings 410*a* and 410*b*, and a non-magnetic substance 414 may be installed between the first housing 410*a* and the fourth housing 410*d*.

The difference between the electromagnetic force driving device 400 according to the third embodiment and the electromagnetic force driving device 200 according to the first embodiment is installation directions of the first and second housings 410*a* and 410*b*, and the first housing 410*a* according to the third embodiment is arranged such that the groove unit formed in the length direction is parallel to the length direction of the coil unit 430 of the second housing 410*b*.

The first mover 420 is installed on the top of the first housing 410*a* to be movable in the vertical direction and fixed to the first housing 410*a* to be selectively positioned at the top dead point or the bottom dead point, and a first mover lower body 421 of a plate shape moving along the first motion path 411 of the first housing 410*a* is spaced apart from the first mover 420 by a certain distance under the first mover 420 of a plate shape and connected to the first mover 420 through a first mover link 421*a*.

In addition, the first mover 420 is protruded from the bottom surface of the body of the first mover 420 by a certain thickness to form a first attaching unit 420*a*, and if the first mover 420 moves downwards, the first mover 420 forms a magnetic field together with the upper magnet 450 so that the first mover 420 may maintain a state of being tightly attached to the first housing 410*a*.

In addition, the first mover lower body 421 is protruded from the top surface of the first mover lower body 421 by a certain thickness to form a second attaching unit 421*b*, and if the first mover lower body 421 moves upwards, the first mover lower body 421 forms a magnetic field together with the upper magnet 450 so that the first mover lower body 421 may maintain a state of being tightly attached to the first housing 410*a*, and the first mover 420 and the first mover lower body 421 are configured of a magnetic substance.

The coil unit 430 is a configuration installed inside the second housing 410*b* to be movable in the vertical direction and providing a driving force so as to move in a direction perpendicular to the magnetic field of the lower magnet 460 (either upwards or downwards in the figure) by a magnetic flux density generated by the lower magnet 460, a density of current supplied to the coil unit 430 and an electromagnetic repulsive force according to the direction of current supplied in a forward or reverse direction, and since a conductive wire is wound (wrapped) in an approximate oval shape, the current may flow in a forward or reverse direction.

The coil unit 430 is installed to penetrate the second housing 410*b* in the lateral direction, and the second mover 440 is installed on the coil unit 430 so that operation of the coil unit 430 can be performed together with the first mover 420.

The second mover 440 is a pipe shaped member, in which one end is combined with the top of the coil unit 430, and the other end passes through the second mover penetration hole 413 of the fourth housing 410*d* to be connected to the first mover 420, to operate the first mover 420 to move in the vertical direction according to the vertical movement of the coil unit 430.

The upper magnet 450 is a bar shaped permanent magnet tightly attached to either the first mover 420 or the first mover lower body 421 to form a magnetic field for moving the first mover 420 upwards and maintaining the top dead point or to form a magnetic field for moving the first mover 420 downwards and maintaining the bottom dead point where the first mover 420 is tightly attached to the top surface of the first housing 410*a* and thus provides a holding force (magnetic force) so that the first mover 420 may maintain either the top dead point or the bottom dead point.

In addition, a first magnetic substance 451 is installed at both sides of the upper magnet 450 and may provide an appropriate holding force to the first mover 420 or the first mover lower body 421 according to the usage of installation by freely changing the size of the upper magnet 450.

The first magnetic substance 451 is installed at both sides of the upper magnet 450 so that the upper magnet 450 may be fixed to the first housing 410*a*, has a magnet installation groove 451*a* formed in the length direction to insert the upper magnet 450, and forms a magnetic circuit together with the first mover 420 or the first mover lower body 421 through the magnetic field formed by the upper magnet 450.

In addition, a non-magnetic substance 452 is installed between the first magnetic substance 451 and the first housing 410*a* to prevent the magnetic field formed by the upper magnet 450 and the first magnetic substance 451 from being formed at the first housing 410*a* which is a magnetic substance, and a first mover link penetration hole 452*a* is formed so that the first mover link 421*a* which connects the first mover 420 and the first mover lower body 421 may pass through.

The lower magnet 460 is a configuration installed inside the second housing 410*b* to form a magnetic field around the coil unit 430, in which a first lower magnet 460*a*, a second lower magnet 460*b*, a third lower magnet 460*c* and a fourth lower magnet 460*d* are sequentially arranged around the coil unit 430 and form a magnetic field to generate a repulsive force for moving the coil unit 430 upwards or downwards according to a direction of current supplied to the coil unit 430.

In addition, the first non-magnetic substance 470 and the second non-magnetic substance 471 are installed above and below the first to fourth lower magnets, respectively, between the first to fourth lower magnets 460*a*, 460*b*, 460*c* and 460*d* and the fourth housing 410*d* and between the first to fourth lower magnets 460*a*, 460*b*, 460*c* and 460*d* and the third housing 410*c* to form a magnetic path by maintaining a distance, and N poles and S poles of the first to fourth lower magnets 460*a*, 460*b*, 460*c* and 460*d* are sequentially arranged inside the second housing 410*b* centering on the coil unit 430 so that a magnetic field may be formed in a predetermined direction.

Fourth Embodiment

Figure 9:
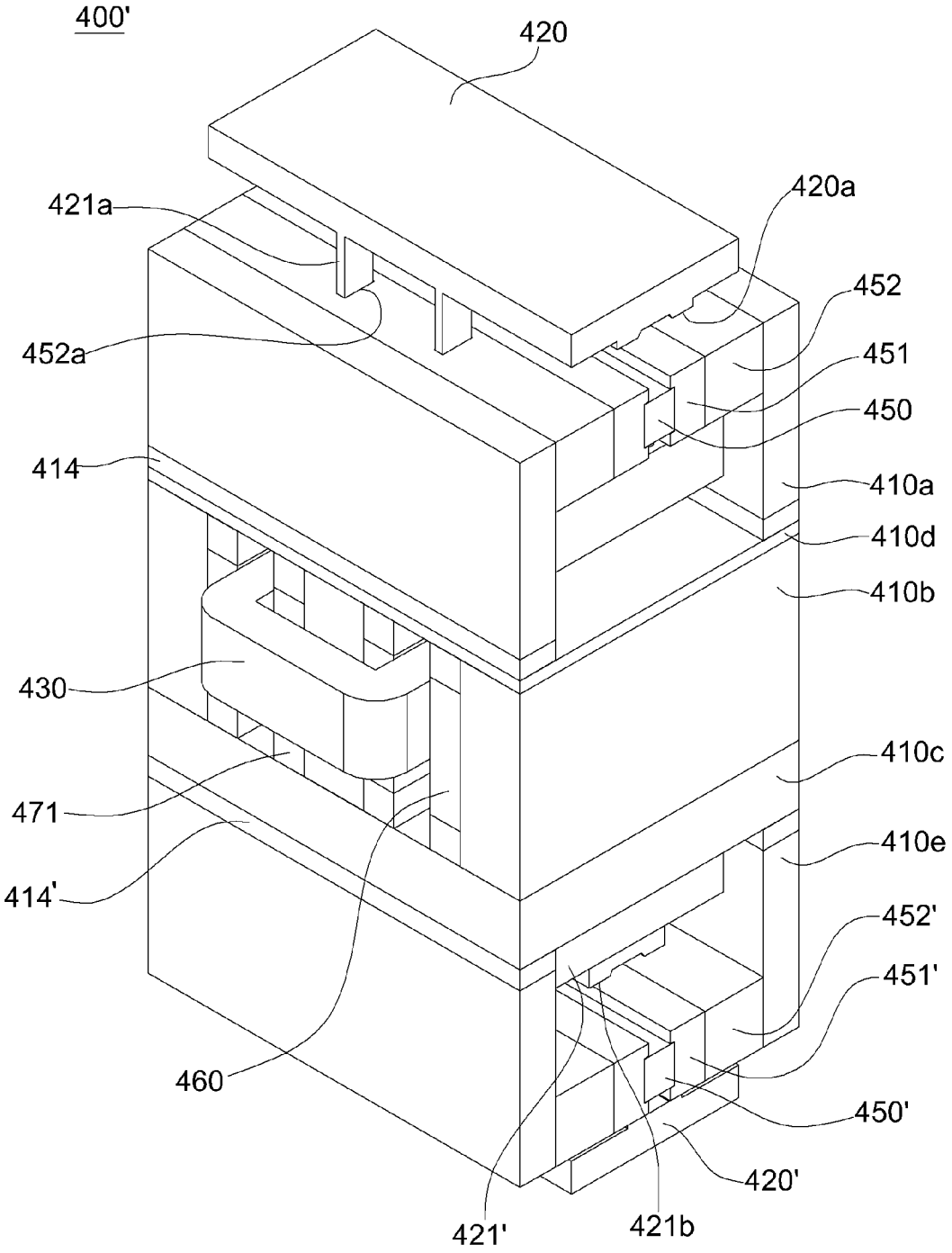
FIG. 9 is a perspective view showing a fourth embodiment of an electromagnetic force driving device according to the present invention.
Figure 10:
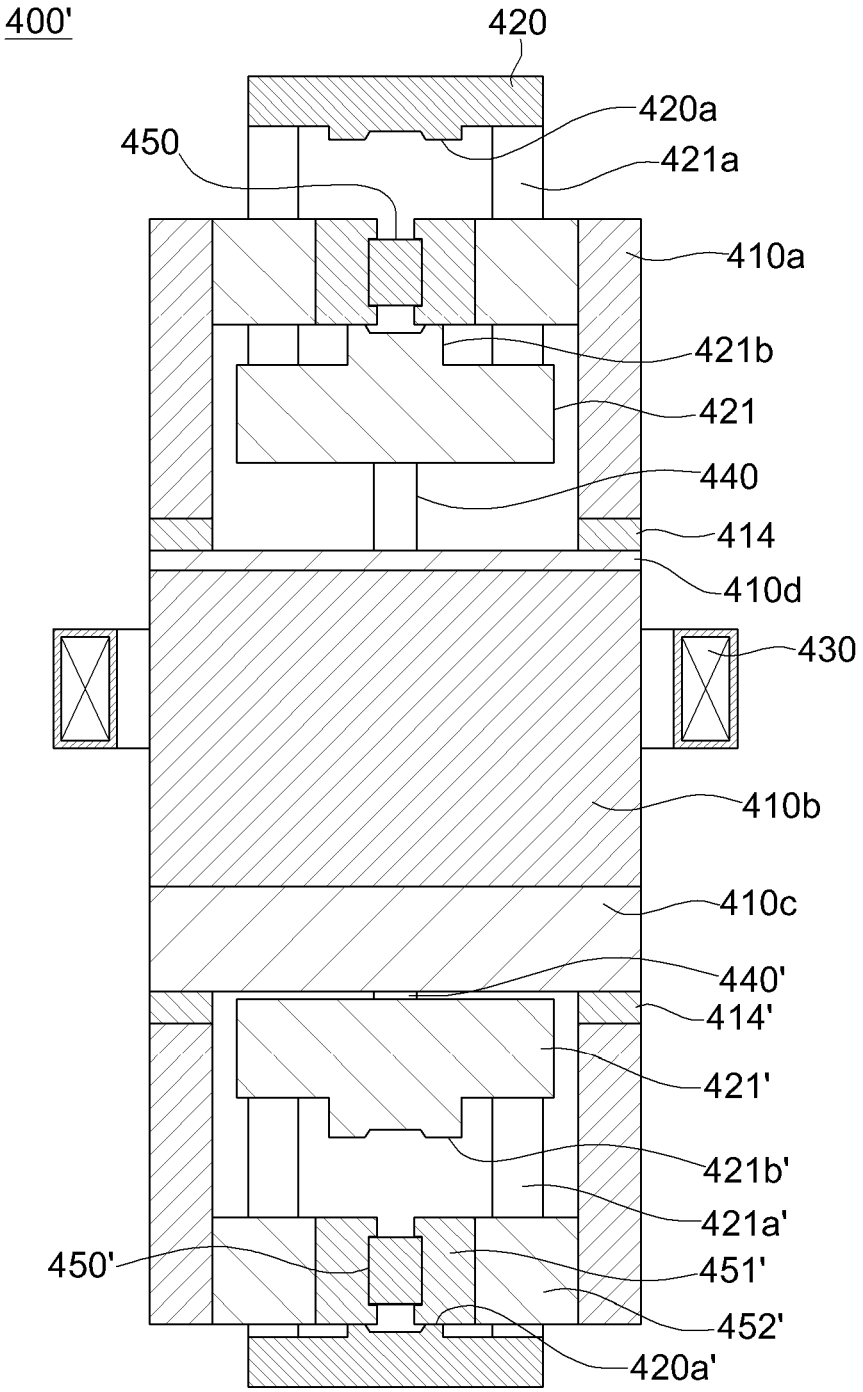
FIG. 10 is a cross-sectional view showing the structure of the electromagnetic force driving device according to FIG. 9.

FIG. 9 is a perspective view showing a fourth embodiment of an electromagnetic force driving device according to the present invention, and FIG. 10 is a cross-sectional view showing the structure of the electromagnetic force driving device according to FIG. 9.

As shown in FIGS. 9 and 10, the electromagnetic force driving device 400' according to a fourth embodiment of the present invention is configured to include a housing 410, a first mover 420, a first supporting mover 420', a coil unit 430, a second mover 440, a second supporting mover 440', an upper magnet 450, a supporting magnet 450', a lower magnet 460, a first non-magnetic substance 470 and a second non-magnetic substance 471.

The housing 410' is a magnetic substance configured to include a first housing 410*a*, a second housing 410*b*, a third housing 410*c*, a fourth housing 410*d*, and a supporting housing 410*e*.

The supporting housing 410*e* is installed in a direction opposite to the first housing 410*a* from the second housing 410*b*, separated from the second housing 410*b* through the third housing 410*c*, and configured in a shape the same as the first housing 410*a* of the third embodiment, and a non-magnetic substance 414' may be installed between the third housing 410*c* and the supporting housing 410*e*.

In addition, a first supporting mover 420' and a supporting magnet 450' are installed in the supporting housing 410*e*, and a motion path for moving the first supporting mover 420' is formed inside the supporting housing 410*e*.

The difference between the electromagnetic force driving device 400' according to the fourth embodiment and the electromagnetic force driving device 100' according to the second embodiment is installation directions of the first and supporting housings 410*a* and 410*e* and the second housing 410*b*, and the first housing 410*a* and the supporting housing 410*e* according to the fourth embodiment are arranged such that the groove units formed in the length direction are parallel to the length direction of the coil unit 430 of the second housing 410*b*.

The first supporting mover 420' is a magnetic substance installed on the bottom of the supporting housing 410*e* to be movable in the vertical direction and fixed to the supporting housing 410*e* to be selectively positioned at the top dead point or the bottom dead point, and a first supporting mover lower body 421' of a plate shape moving along the motion path of the supporting housing 410*e* is spaced apart from the first supporting mover 420' by a certain distance under the plate shaped first supporting mover 420' and connected to the first supporting mover 420' through a first supporting mover link 421*a'*.

In addition, the first supporting mover 420' is protruded from the body of the first supporting mover 420' by a certain thickness to form a first supporting attaching unit 420*a'*, and if the first supporting mover 420' moves upwards, the first supporting mover 420' forms a magnetic field together with the supporting magnet 450' and maintains a state of being tightly attached to the supporting housing 410*e*.

In addition, the first supporting mover lower body 421' is protruded from the bottom surface of the first supporting mover lower body 421' by a certain thickness to form a second supporting attaching unit 421*b'*, and if the first supporting mover lower body 421' moves downwards, the first supporting mover lower body 421' forms a magnetic field together with the supporting magnet 450' so that the first supporting mover lower body 421' may maintain a state of being tightly attached to the supporting housing 410*e*, and the first supporting mover 420' and the first supporting mover lower body 421' are configured of a magnetic substance.

The second supporting mover 440' is a pipe shaped member, in which one end is combined with the bottom of the coil unit 430, and the other end passes through the third housing 410*c* to be connected to the first supporting mover 420', to operate the first supporting mover 420' to move in the vertical direction according to the vertical movement of the coil unit 430.

The supporting magnet 450' is a bar shaped permanent magnet tightly attached to either the first supporting mover 420' or the first supporting mover lower body 421' to form a magnetic field for moving the first supporting mover 420' upwards and maintaining the top dead point or to form a magnetic field for moving the first supporting mover 420' downwards and maintaining the bottom dead point where the first supporting mover 420' is tightly attached to the supporting housing 410*e* and thus provides a holding force (magnetic force) so that the first supporting mover 420' may maintain either the top dead point or the bottom dead point.

In addition, a first supporting magnetic substance 451' is installed at both sides of the supporting magnet 450' and may provide an appropriate holding force to the first supporting mover 420' or the first supporting mover lower body 421' according to the usage of installation by freely changing the size of the supporting magnet 450'.

The first supporting magnetic substance 451' is installed at both sides of the supporting magnet 450' so that the supporting magnet 450' may be fixed to the supporting housing 410*e*, has a magnet installation groove formed in the length direction to insert the supporting magnet 450', and forms a magnetic circuit together with the first supporting mover 420' or the first supporting mover lower body 421' through the magnetic field formed by the supporting magnet 450'.

Meanwhile, a supporting non-magnetic substance 452' is installed between the first supporting magnetic substance 451' and the supporting housing 410*e* to prevent the magnetic field formed by the supporting magnet 450' and the first supporting magnetic substance 451' from being formed at the supporting housing 410*e* which is a magnetic substance, and a first supporting mover link penetration hole is formed so that the first supporting mover link 421*a'* which connects the first supporting mover 420' and the first supporting mover lower body 421' may pass through.

Accordingly, when an error occurs in a power distribution and transmission line, it can be promptly cut off, and the overall weight and size can be reduced by simplifying the structure of the electromagnetic force driving device by combining a magnetic substance and a coil unit through a connection pin inside thereof, and, in addition, electromagnetic characteristics and a holding force can be easily changed by forming independent motion paths for moving the mover and the coil unit.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

In addition, in the process of describing embodiments of the present invention, thickness of the lines and sizes of the elements shown in the figures may be exaggerated for clarity and convenience of the descriptions, and the terms described above are terminologies defined considering the functions of the present invention, and since meanings thereof may vary depending on the intention of an operator or common practices, definitions of the terms should be made based on the overall contents of this specification.

What is claimed is:

1. An electromagnetic force driving device comprising:

a housing including a first housing in which a first mover is installed, a second housing in which a coil unit is installed, a third housing installed on a bottom surface of the second housing, and a fourth housing for partitioning the first housing and the second housings;

a first mover installed on a top of the first housing to be movable in a vertical direction;

a coil unit installed in parallel to the second housing to move either upwards or downwards by a repulsive force according to a direction of current supplied in a forward direction or a reverse direction;

a second mover, one end of which is combined with the coil unit, and the other end of which passes through the fourth housing to be connected to the first mover, to operate the first mover according to a movement of the coil unit;

an upper magnet installed in the first housing to be tightly attached to the first mover to provide a magnetic force for the first mover to maintain either a top dead point or a bottom dead point; and a lower magnet installed in the second housing to form a magnetic field using the coil unit.

2. The device according to claim 1, wherein the second housing includes:

a first non-magnetic substance installed between the fourth housing and the lower magnet; and a second non-magnetic substance installed between the lower magnet and the third housing.

3. The device according to claim 1, wherein the first mover includes:

a first mover lower body connected to a bottom surface of a body of the first mover through a first mover link;

a first attaching unit protruded from the body of the first mover by a certain thickness to be tightly attached to the upper magnet through a magnetic field; and a second attaching unit protruded from the first mover lower body by a certain thickness to be tightly attached to the upper magnet through a magnetic field.

4. The device according to claim 1, wherein the upper magnet further includes:

a first magnetic substance installed at both sides of a body of the upper magnet to form a path of a magnetic field; and a first non-magnetic substance having a first mover link penetration hole formed for the first mover link to pass through and preventing a magnetic field formed by the upper magnet and the first magnetic substance from being formed at the first housing.

5. The device according to claim 1, further comprising:

a supporting housing installed under the third housing of the housing;

a first supporting mover installed under the supporting housing to be movable in a vertical direction;

a second supporting mover, one end of which is combined with the coil unit, and the other end of which passes through the third housing to be connected to the first supporting mover, to operate the first supporting mover according to a movement of the coil unit; and a supporting magnet installed in the supporting housing to be tightly attached to the first supporting mover to provide a magnetic field for the first supporting mover to maintain either the top dead point or the bottom dead point.

6. The device according to claim 5, wherein the first supporting mover includes:

a first supporting mover lower body connected to a bottom surface of a body of the first supporting mover through a first supporting mover link;

a first supporting attaching unit protruded from the body of the first supporting mover by a certain thickness to be tightly attached to the supporting magnet through a magnetic field; and a second supporting attaching unit protruded from the first supporting mover lower body by a certain thickness to be tightly attached to the supporting magnet through a magnetic field.

7. The device according to claim 5, wherein the supporting magnet further includes:

a first supporting magnetic substance installed at both sides of a body of the supporting magnet to form a path of a magnetic field; and a first supporting non-magnetic substance having a first supporting mover link penetration hole formed for the first supporting mover link to pass through and preventing a magnetic field formed by the supporting magnet and the first supporting magnetic substance from being formed at the supporting housing.

8. The device according to claim 5, wherein the first housing and the supporting housing are arranged to be parallel or perpendicular to a length direction of the coil unit of the second housing.

* * * * *